US009896786B2

(12) United States Patent
Boetsch et al.

(10) Patent No.: US 9,896,786 B2
(45) Date of Patent: Feb. 20, 2018

(54) SYSTEMS AND METHODS FOR IMPROVING AND CONTROLLING YARN TEXTURE

(71) Applicant: Columbia Insurance Company, Omaha, NE (US)

(72) Inventors: Eric Beard Boetsch, Aiken, SC (US); Kevin Cowart, Aiken, SC (US); Mark Spangler, North Augusta, SC (US); Larry Sims, Dalton, GA (US); Brent Brown, Calhoun, GA (US); Nathan Smith, Columbia, SC (US); Chris Cooper, Aiken, SC (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 246 days.

(21) Appl. No.: 13/798,976

(22) Filed: Mar. 13, 2013

(65) Prior Publication Data

US 2014/0053381 A1 Feb. 27, 2014

Related U.S. Application Data

(60) Provisional application No. 61/692,605, filed on Aug. 23, 2012, provisional application No. 61/692,596, filed on Aug. 23, 2012.

(51) Int. Cl.

| | |
|---|---|
| ***D02G 1/00*** | (2006.01) |
| ***D02G 1/12*** | (2006.01) |
| ***D02G 1/20*** | (2006.01) |

(52) U.S. Cl.

CPC ..... *D02G 1/125* (2013.01); *D02G 1/12* (2013.01); *D02G 1/20* (2013.01)

(58) Field of Classification Search

CPC D02G 1/125; D02G 1/12; D02G 1/00; D02G 1/20; D02G 1/167; D02G 1/122; D02J 13/00; D02J 13/001; F24F 3/1405

(Continued)

(56) References Cited

U.S. PATENT DOCUMENTS 3,939,240 A * 2/1976 Savich ..... A61F 13/15626 19/148
4,046,990 A * 9/1977 White ..... G03G 15/2039 219/471

(Continued)

FOREIGN PATENT DOCUMENTS

WO WO9316218 A1 8/1993
WO 2012096799 A1 7/2012

OTHER PUBLICATIONS

International Search Report and the Written Opinion of the International Search Authority for Application No. PCT/US2013/056180 (dated Jan. 10, 2014).

(Continued)

*Primary Examiner* — Clinton T Ostrup
*Assistant Examiner* — Abby Spatz
(74) *Attorney, Agent, or Firm* — Ballard Spahr LLP

(57) ABSTRACT

A system and method for controlling and improving the consistency of yarn texture in a yarn system. The system and method are configured to monitor, improve and/or control the operating parameters of the yarn system. A plurality of sensors sense the operating conditions and send the sensed conditions to a processor. The processor and/or a user monitoring the system can make adjustments to the operating parameters in a parameter is outside of a predetermined tolerance.

13 Claims, 12 Drawing Sheets

(58) Field of Classification Search
USPC ..... 28/249, 265, 266, 248, 267, 250, 251, 28/268, 221
See application file for complete search history.

(56) References Cited

U.S. PATENT DOCUMENTS

| | | | | |
|---|---|---|---|---|
| 5,020,198 | A * | 6/1991 | Hill et al. | 28/250 |
| 5,036,568 | A | 8/1991 | Goineau | |
| 5,351,374 | A * | 10/1994 | Nabulon | D02G 1/122 28/248 |
| 5,408,730 | A * | 4/1995 | Yamamoto | D02G 1/0273 28/220 |
| 5,727,293 | A * | 3/1998 | Weder | D02G 1/122 2/248 |
| 5,802,832 | A * | 9/1998 | Foster | D02G 1/02 28/248 |
| 6,129,673 | A * | 10/2000 | Fraden | G01J 5/04 374/E13.003 |
| 6,195,856 | B1 * | 3/2001 | Kremer | D02H 3/02 28/185 |
| 6,302,308 | B1 * | 10/2001 | Hoover | B65H 51/14 226/118.2 |
| 7,137,238 | B2 | 11/2006 | Maccabruni et al. | |
| 7,168,141 | B2 * | 1/2007 | Stundl | D02G 1/122 28/263 |
| 7,735,204 | B2 | 6/2010 | Hoover | |
| 2004/0031134 | A1 | 2/2004 | Koslowski et al. | |
| 2006/0090316 | A1 | 5/2006 | Kissels et al. | |
| 2008/0301922 | A1 * | 12/2008 | Hoover | D02G 1/12 28/265 |
| 2014/0317895 | A1 * | 10/2014 | Stundl | D02G 1/12 28/250 |

OTHER PUBLICATIONS

U.S. Appl. No. 61/692,605, filed Aug. 23, 2012, Boetsch et al.
U.S. Appl. No. 61/791,207, filed Mar. 15, 2013, Boetsch et al.
U.S. Appl. No. 14/216,574, filed Mar. 17, 2014, Boetsch et al., (US-2014-0196264-A1), (Jul. 17, 2014).
U.S. Appl. No. 14/664,044, filed Mar. 20, 2015, Boetsch et al., (US-2015-0191855-A1), (Jul. 9, 2015).
Final Rejection dated Jun. 28, 2017 by the USPTO for U.S. Appl. No. 14/216,574, filed Mar. 17, 2014 and published as US 2014-0196264 A1 on Jul. 17, 2014 (Applicant-Shaw Industries Group, Inc.; Inventor-Eric Beard Boetsch, et al.) (38 pages).
Non Final Rejection dated Jun. 30, 2017 by the USPTO for U.S. Appl. No. 14/664,044, filed Mar. 20, 2015 and published as US 2015-0191855 A1 on Jul. 9, 2015 (Applicant-Shaw Industries Group, Inc.; Inventor-Eric Beard Boetsch, et al.) (40 pages).
Requirement for Restriction/Election dated May 18, 2016 by the U.S. Patent and Trademark Office for U.S. Appl. No. 14/216,574, filed Mar. 17, 2014 and published on US-2014-0196264-A1 on Jul. 17, 2014 (Inventor-Eric Beard Boetsch et al; Applicant-Shaw Industries Group, Inc.) (9 pages).
Response to Requirement for Restriction/Election dated Jul. 18, 2016 to the U.S. Patent and Trademark Office for U.S. Appl. No. 14/216,574, filed Mar. 17, 2014 and published on US-2014-0196264-A1 on Jul. 17, 2014 (Inventor-Eric Beard Boetsch et al; Applicant-Shaw Industries Group, Inc.) (11 pages).

* cited by examiner

SYSTEMS AND METHODS FOR IMPROVING AND CONTROLLING YARN TEXTURE

CROSS REFERENCE TO RELATED APPLICATIONS

This application claims the benefit of and priority to U.S. Provisional Patent Application No. 61/692,605 filed on Aug. 23, 2012 and U.S. Provisional Patent Application No. 61/692,596 filed on Aug. 23, 2012. Each of the above-referenced applications is hereby incorporated by reference in full and made a part hereof.

FIELD OF THE INVENTION

This invention relates generally to controlling and improving the consistency of yarn texture in a yarn system. More specifically, systems and methods are provided for monitoring, improving and/or controlling the formation of a texture in the yarn.

BACKGROUND OF THE INVENTION

A large portion of carpets used in residences are known as pile carpets formed by tufting pile yarn into a primary backing material. The yarns tufted into the primary backing form the fibrous face of the carpet. The tufted loops can optionally be cut or sheared to form tufts of a desired, constant vertical height.

Two general categories of tufted carpets are (1) a textured style, in which the tufts and the individual filaments or staples have varying degrees of crimp or curl; and (2) a straight-set style, in which the filaments or staples at the tuft tip are straight and substantially perpendicular to the plane of the carpet face. Addressing the first category of carpets, yarn that is used as pile in textured style carpets is prepared by cabling together a plurality of single yarns and setting them in their twisted condition. A texturing apparatus can be any convenient or desirable texturing device such as a texturing gear and/or or stuffier box that imparts a texture in the yarn. For example, a yarn strand exiting a drawing apparatus or a creel can be fed through texturing wheels and/or gears of a twin roll box to impart a texture into the yarn.

The yarn can also be fed into the stuffer box, within which the yarn is allowed to selectively pile up, thereby forming a yarn plug. As is typical of known texturing apparatuses, the movement of yarn into the stuffer box causes the yarn to collide initially with an end wall, and subsequently with itself, thus forming additional bends and similar shapes, called crimps, in the yarn strand as it resides therein the stuffer box. Because the yarn can be exposed to heated air, the yarn is softened. As a result, the formed crimp can be substantially permanently set therein the yarn strand as the yarn strand is subsequently cooled.

The step of texturing the yarns with the stuffer box, however, creates some issues that do not exist when producing the straight-style carpet. One such recurring problem, for example, is locating the yarn plug in a desired position in the stuffer box, because if the yarn plug is positioned in a desired location within the stuffer box, yarn texture consistency can be improved. For example, it can be desirable for yarn to form a yarn plug at only the front or alternatively the rear of the stuffer box. Thus, there is a need in the art for a device for monitoring, improving and/or controlling the position of the yarn plug within the stuffer box Yarn is typically fed to the texturing apparatus with at least one pre-feed roller. The at least one pre-feed roller is a driven roll around which the yarn can wrap. However, if the speed of the at least one pre-feed roller varies, tension in the yarn being fed to the texturing apparatus can change, and the yarn crimped by the texturing apparatus can vary. When this yarn is woven or tufted into a finished product, such as, for example and without limitation, carpet, the variations in the yarn can be readily apparent. Furthermore, other manufacturing variations can create variations in the consistent, controlled formation of the texture in the yarn. For example, variations in the process temperature or pressure can reduce the consistency of the yarn being produced which will become apparent when the yarn is woven or tufted into a finished product. Thus, there is a need in the art for monitoring, improving and/or controlling the formation of a texture in the yarn.

SUMMARY OF THE INVENTION

In accordance with the purpose(s) of this invention, as embodied and broadly described herein, this invention, in one aspect, relates to systems and methods for monitoring, improving and/or controlling the texture of yarn in a yarn system.

In one aspect, the system for monitoring, improving and/or controlling comprises at least one roller for transporting yarn and at least one sensor. An outer surface of the at least one roller can comprise a frictioned surface configured to grip yarn that is wrapped around at least a portion of the roller.

The at least one sensor can be configured to sense an operating parameter of the yarn system, according to one aspect. For example, the operating parameter can comprise at least one of: speed of the yarn, temperature of the yarn, pressure of fluid used in processing the yarn, and locations of the yarn relative to a predetermined position in the yarn system. In another aspect, the at least one sensor can be a proximity sensor configured to sense the absence or presence of an object. For example, the sensor can be a photoelectric sensor configured to sense the absence or presence of an object by using a light transmitter and a photoelectric receiver. In another aspect, the at least one sensor can be positioned spaced from or adjacent the at least one roller and can be configured to sense the absence or presence of an identifying mark on a portion of the outer surface of the roller.

In use, the at least one roller can be driven by a motor so that yarn wrapped around at least a portion of the roller moves through the yarn system. The at least one sensor can send a signal towards the identifying mark of the roller. When the identifying mark is in a predetermined position, the signal from the sensor can be reflected by the identifying mark back to the sensor. The sensor and/or a processor coupled to the sensor can calculate the rate at which the at least one roller is rotating based on the number of times the identifying mark is sensed per a predetermined time period. The sensor and/or the processor can convert this rotational rate into a linear rate, such as meters per minute, and this rate can be displayed on a display device. The processor and/or a user of the system monitoring the display device can adjust the rotational speed of the motor, and thus the speed of the at least one roller, so that a desired rate of yarn is processed within a predetermined tolerance. For example, the user of the system and/or the processor can speed up or slow down the motor so that the rate at which yarn is processed stays within the predetermined tolerance of the desired rate.

In one aspect, the yarn system comprises a stuffer box for yarn. In another aspect, the stuffer box has an internal chamber having a sidewall, an inlet end and an outlet end through which yarn can pass. In another aspect, at least one bore can be defined in a portion of the at least one sidewall to form a window such that at least a portion of the internal chamber of the stuffer box is visible through the window. A transparent or translucent material can cover the bore to prevent yarn from exiting the internal chamber through the bore, while allowing light to enter and exit the internal chamber.

In one aspect, the at least one sensor can be a proximity sensor positioned outside the internal chamber of the stuffer box and can be configured to sense the absence or presence of yarn and/or another obstruction in the internal chamber by sending a signal through the window of the stuffer box.

In use, the at least one sensor can send a signal through the window to sense if a yarn plug is positioned in a predetermined position therein the internal chamber of the stuffer box. Depending on the absence or presence of yarn and/or another obstruction in the predetermined position, as sensed by the sensor, a processor coupled to the sensor can cause the rate at which yarn is fed into the stuffer box to be altered. For example, the processor can start, stop, speed up or slow down the rate at which yarn is fed into the stuffer box as desired by a user of the system.

In another aspect, the operating parameters sensed by the at least one sensor can be sent to the processor and/or a display device. The processor can alter operation of the yarn system if a condition is outside of a predetermined tolerance for a predetermined amount of time. For example, if a yarn temperature is sensed outside of a predetermined yarn temperature tolerance for the predetermined amount of time, the processor can send a signal slowing down, speeding up, or stopping the at least one roller. In another example, if a yarn temperature is sensed outside of the predetermined yarn temperature tolerance for the predetermined amount of time, the processor can send a signal to adjust the speed of a vacuum fan (or any other predetermined operation in the yarn system) configured to cool the yarn. In still another example, if a yarn temperature is sensed outside of the predetermined yarn temperature tolerance for the predetermined amount of time, the processor can display the condition on a display device so that a user monitoring the system can manually change the operating parameter.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DESCRIPTION OF THE PREFERRED EMBODIMENTS

Figure 1:
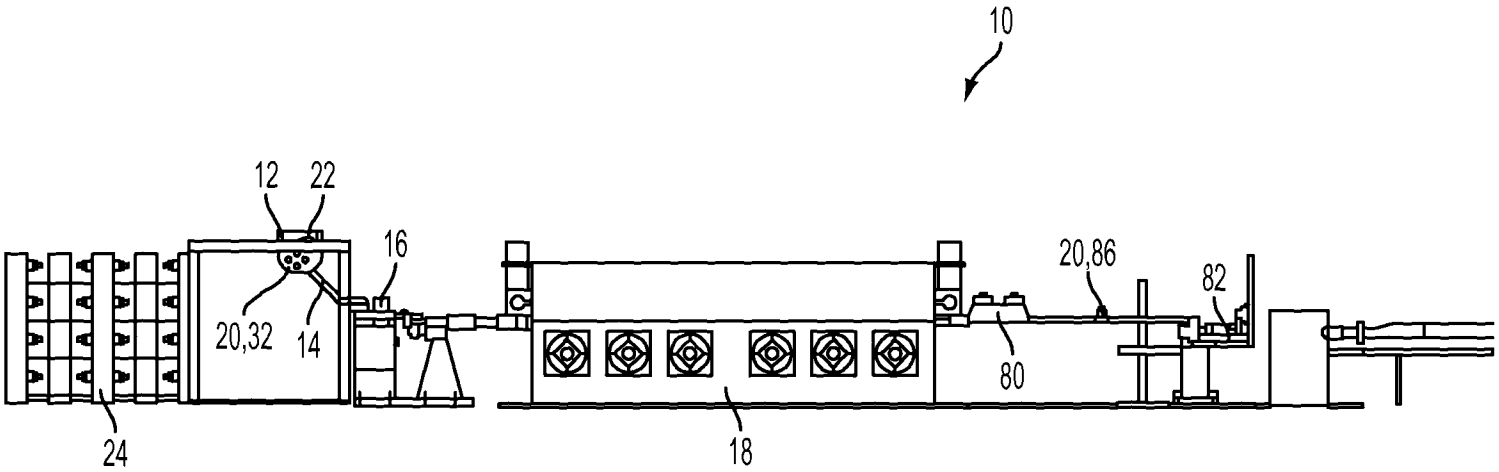
FIG. 1 is a side elevational view of one embodiment of a yarn system comprising a texturing apparatus for adding texture to yarn, and a system for monitoring, improving and/or controlling yarn texture.

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a yarn" can include two or more such yarns unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

In one broad aspect, the present invention comprises systems and methods for controlling and improving the consistency of yarn texture in a yarn system. More specifically, systems and methods are provided for monitoring, improving and/or controlling the speed, pressure, temperature and the like of yarn in a yarn system.

Figure 2:
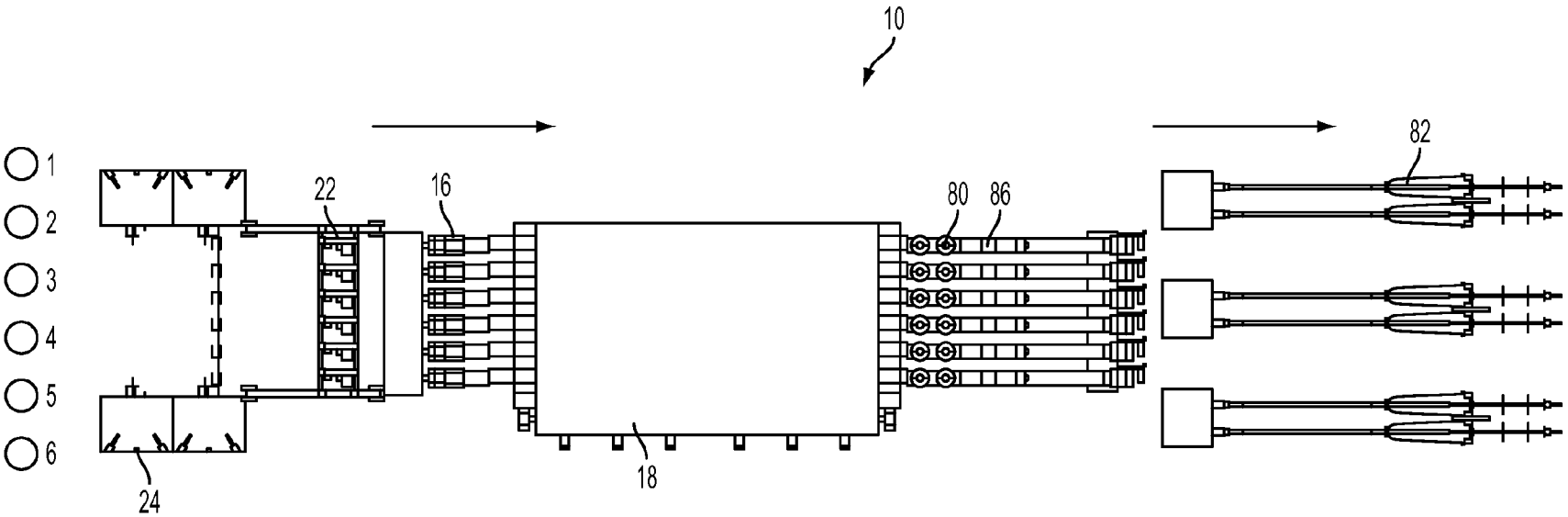
FIG. 2 is a top plan view of the systems of FIG. 1.
Figure 3:
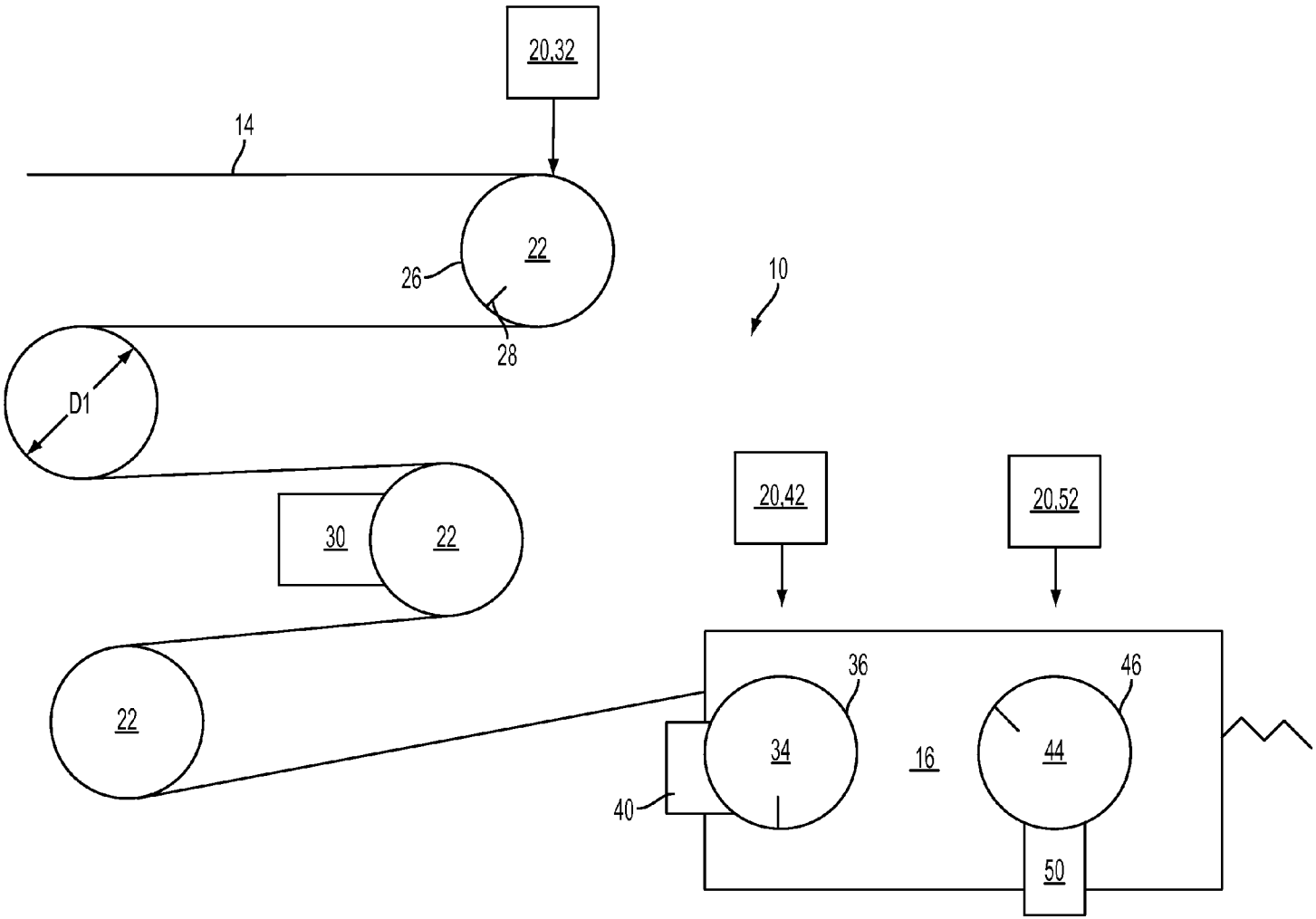
FIG. 3 is schematic view of a portion of the systems of FIG. 1, showing a plurality of driven rollers and a plurality of sensors, according to one aspect.
Figure 4:
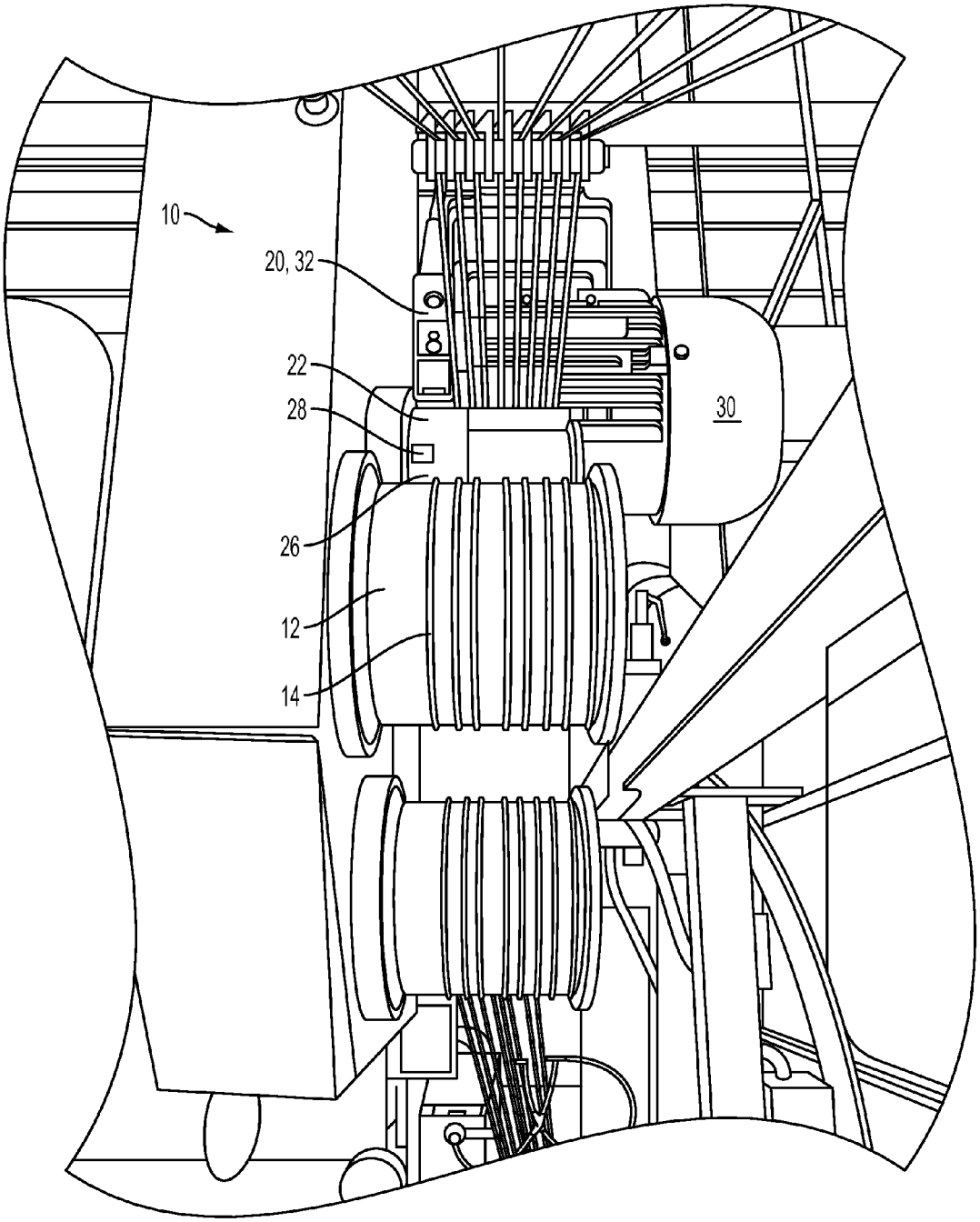
FIG. 4 is a perspective view of a roller and a roller speed sensor of the system for monitoring, improving and/or controlling yarn texture of FIG. 1, according to one aspect.
Figure 5:
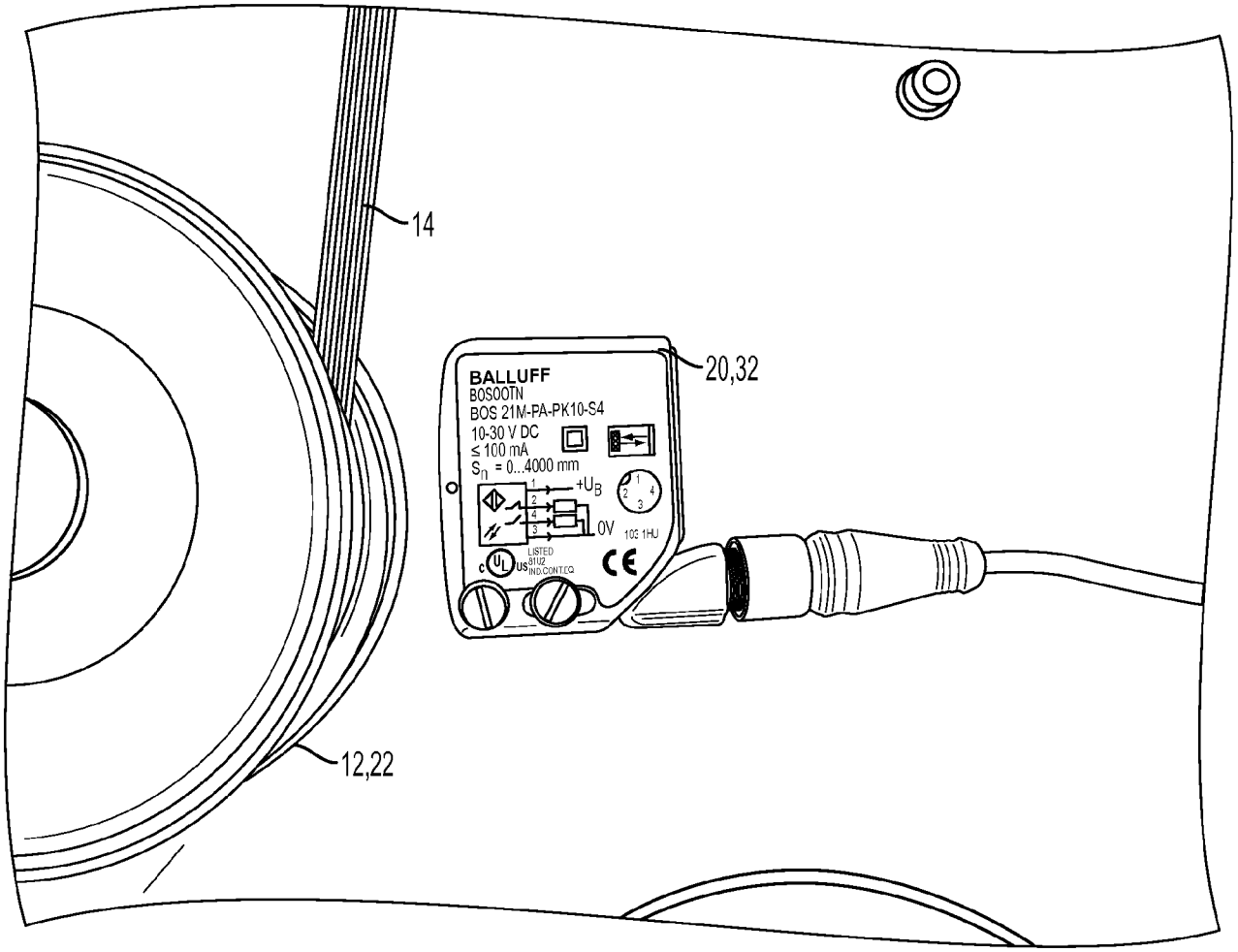
FIG. 5 is a side elevational view of the roller and sensor of FIG. 4.

With reference to FIGS. 1 and 2, in one aspect, the system 10 for controlling and improving the consistency of yarn texture comprises at least one of: a plurality of rollers 12 for yarn 14, at least one texturing apparatus 16, a climate chamber 18, and a plurality of sensors 20. In one aspect, at least portions of the system can be a GVA 5009 heatset machine produced by POWER-HEAT-SET of Toging, Germany. In use, as will be described more fully below, the plurality of rollers can feed yarn into the texturing chamber, wherein the yarn is crimped or curled. This crimp or curl can be permanently set in the yarn in the climate chamber. The plurality of sensors can sense an operating condition of the system, such as, for example and without limitation, yarn speed, yarn temperature, air pressure and steam pressure.

Referring now to FIGS. 3-5 and 7, in one aspect, the plurality of rollers 12 can comprise a plurality of driven rollers. In another aspect, the plurality of driven rollers can comprise at least one of at least one overfeed roller 22, at least one delivery roller 34, and at least one stuffing pressure roller 44. In yet another aspect, the overfeed roller can be configured to move yarn from a creel 24 and towards the texturing apparatus 16, such as, for example and without limitation, a stuffer box 58. The at least one overfeed roller can be a substantially cylindrical roller, though other shapes such as substantially conical, frustoconical and the like are contemplated. In still another aspect, the at least one overfeed roller 22 can have an outer surface 26 having an outer diameter $D_1$. The outer surface of the at least one overfeed roller can comprise a frictioned surface such as stainless steel, rubber and the like.

According to one aspect, an identifying mark 28 can be formed on the outer surface 26 of the at least one overfeed roller 22. In another aspect, the identifying mark can be an elongate linear mark positioned substantially parallel to a longitudinal axis $L_A$ of the at least one overfeed roller. For example and without limitation, the identifying mark can be a piece of reflective tape positioned on the at least one overfeed roller 22, a groove defined in the at least one overfeed roller, a stripe painted on the at least one overfeed roller and the like. Alternatively, a portion of the at least one overfeed roller 22 can be formed from a material having a reflective surface so that a separate identifying mark is not required. In another aspect, the identifying mark can be positioned on the overfeed roller 22 such that, during use, yarn 14 will not touch and/or cover at least a portion of the identifying mark.

In one aspect, the at least one overfeed roller 22 can be coupled to at least one overfeed motor 30 configured to drive the at least one overfeed roller. In another aspect, if the at least one overfeed roller 22 comprises a plurality of overfeed rollers, then each of the overfeed rollers can be coupled together with gears, chains, and the like, such that one overfeed motor can drive each of the plurality of overfeed rollers. In this aspect, a change in the rotational speed of the at least one overfeed motor 30 would correspondingly change the rotational speed of each of the plurality of overfeed rollers 22. Alternatively, if the at least one overfeed roller comprises a plurality of overfeed rollers, one overfeed motor can drive at least one overfeed roller, and a second overfeed motor can drive at least one overfeed roller. In this example, each roller of the at least one roller can be coupled to a respective overfeed motor 30.

As previously discussed, the systems and methods for monitoring, controlling and/or improving the consistency of yarn texture comprise a plurality of sensors 20. In one aspect, at least one sensor of the plurality of sensors can be an overfeed sensor 32. The overfeed sensor can be a proximity sensor configured to sense the absence or presence of an object, according to one aspect. In another aspect, the overfeed sensor can be a photoelectric sensor configured to sense the absence or presence of an object by using a light transmitter and a photoelectric receiver. For example and without limitation, the overfeed sensor 32 can be a Model BOS 21M-PA-PK10-24 sensor produced by BALLUFF of Neuhausen, Germany. In a further aspect, the overfeed sensor can be an encoder coupled to the at least one overfeed roller 22 or the at least one overfeed motor 30 and configured to sense the rotational speed of the roller or motor. For example, the overfeed sensor 32 can be a Model T8.LI20.1121.2005 READ HEAD, a Model T8.A02H.5BAE.0512 40MM or a Model T8.5020.1552.0512 encoder produced by TURCK of Plymouth, Minn. It is contemplated, however, that other types of overfeed sensors could be used.

In one aspect, the overfeed sensor 32 can be positioned adjacent the at least one overfeed roller 22 so that the signal transmitted from the overfeed sensor (such as light) can be directed toward the identifying mark 28 on the outer surface 26 of the at least one overfeed roller. In another aspect, the overfeed sensor can be positioned adjacent the at least one overfeed roller. In a further aspect, the overfeed sensor 32 can be spaced from the at least one roller a predetermined distance. For example, the overfeed sensor can be spaced from the at least one overfeed roller 22 by less than 1 inch, about 1 inch, 2 inches, about 3 inches, about 4 inches, about 5 inches, about 6 inches, or greater than about 6 inches. If the overfeed sensor 32 is an encoder, as discussed above, the overfeed sensor can be coupled to the at least one overfeed roller 22 or the at least one overfeed motor 30, according to another aspect.

In one aspect, the at least one delivery roller 34 can be configured to move yarn from the overfeed roller 22 to the texturing apparatus 16. The at least one delivery roller can be a substantially cylindrical roller, though other shapes such as substantially conical, frustoconical and the like are contemplated. In another aspect, the at least one delivery roller 34 can have an outer surface 36 having an outer diameter $D_1$. The outer surface of the at least one delivery roller can comprise a frictioned surface such as stainless steel, rubber and the like.

According to one aspect, an identifying mark 28 can be formed on the outer surface 36 of the at least one delivery roller 34. In another aspect, the identifying mark can be an elongate linear mark positioned substantially parallel to a longitudinal axis $L_A$ of the at least one delivery roller. For example and without limitation, the identifying mark can be a piece of reflective tape positioned on the at least one delivery roller 34, a groove defined in the at least one delivery roller, a stripe painted on the at least one delivery roller and the like. Alternatively, a portion of the at least one delivery roller 34 can be formed from a material having a reflective surface so that a separate identifying mark is not required. In another aspect, the identifying mark can be positioned on the delivery roller such that, during use, yarn 14 will not touch and/or cover at least a portion of the identifying mark.

In one aspect, the at least one delivery roller 34 can be coupled to at least one delivery motor 40 configured to drive the at least one delivery roller. In another aspect, if the at least one delivery roller 34 comprises a plurality of delivery rollers, then each of the delivery rollers can be coupled together with gears, chains, and the like, such that one delivery motor can drive each of the plurality of delivery rollers. In this aspect, a change in the rotational speed of the at least one delivery motor 40 would correspondingly change the rotational speed of each of the plurality of delivery rollers 34. Alternatively, if the at least one delivery roller comprises a plurality of delivery rollers, one delivery motor can drive at least one delivery roller, and a second delivery motor can drive at least one delivery roller. In this example, each roller of the at least one delivery roller 34 can be coupled to a respective delivery motor.

In one aspect, at least one sensor 20 of the plurality of sensors can be a delivery sensor 42. The delivery sensor can be a proximity sensor configured to sense the absence or presence of an object, according to one aspect. In another aspect, the delivery sensor can be a photoelectric sensor configured to sense the absence or presence of an object by using a light transmitter and a photoelectric receiver. For example and without limitation, the delivery sensor 42 can be a Model BOS 21M-PA-PK10-24 sensor produced by BALLUFF of Neuhausen, Germany. In a further aspect, the delivery sensor can be an encoder coupled to the at least one delivery roller 34 or the at least one delivery motor 40 and configured to sense the rotational speed of the roller or motor. For example, the delivery sensor 42 can be a Model T8.LI20.1121.2005 READ HEAD, a Model T8.A02H.5BAE.0512 40MM or a Model T8.5020.1552.0512 encoder produced by TURCK of Plymouth, Minn. It is contemplated, however, that other types of delivery sensors could be used.

In one aspect, the delivery sensor 42 can be positioned adjacent the at least one delivery roller 34 so that the signal transmitted from the delivery sensor (such as light) can be directed toward the identifying mark 28 on the outer surface 36 of the at least one delivery roller. In another aspect, the delivery sensor can be positioned adjacent the at least one overfeed roller. In a further aspect, the delivery sensor 42 can be spaced from the at least one delivery roller a predetermined distance. For example, the delivery sensor can be spaced from the at least one delivery roller 34 by less than 1 inch, about 1 inch, 2 inches, about 3 inches, about 4 inches, about 5 inches, about 6 inches, or greater than about 6 inches. If the delivery sensor 42 is an encoder, as discussed above, the delivery sensor can be coupled to the at least one delivery roller 34 or the at least one delivery motor 40, according to another aspect.

In one aspect, the at least one stuffing pressure roller 44 can be configured to move yarn 14 through the texturing apparatus 16. The at least one stuffing pressure roller can be a substantially cylindrical roller, though other shapes such as substantially conical, frustoconical and the like are contemplated. In another aspect, the at least one stuffing pressure roller 44 can have an outer surface 46 having an outer diameter $D_1$. The outer surface of the at least one stuffing pressure roller can comprise a frictioned surface such as stainless steel, rubber and the like.

According to one aspect, an identifying mark 28 can be formed on the outer surface 46 of the at least one stuffing pressure roller 44. In another aspect, the identifying mark can be an elongate linear mark positioned substantially parallel to a longitudinal axis $L_A$ of the at least one stuffing pressure roller. For example and without limitation, the identifying mark can be a piece of reflective tape positioned on the at least one stuffing pressure roller 44, a groove defined in the at least one stuffing pressure roller, a stripe painted on the at least one stuffing pressure roller and the like. Alternatively, a portion of the at least one stuffing pressure roller 44 can be formed from a material having a reflective surface so that a separate identifying mark is not required. In another aspect, the identifying mark can be positioned on the stuffing pressure roller 44 such that, during use, yarn 14 will not touch and/or cover at least a portion of the identifying mark.

In one aspect, the at least, one stuffing pressure roller 44 can be coupled to at least one stuffing pressure motor 50 configured to drive the at least one stuffing pressure roller. In another aspect, if the at least one stuffing pressure roller comprises a plurality of stuffing pressure rollers, then each of the stuffing pressure rollers 44 can be coupled together with gears, chains, and the like, such that one motor can drive each of the plurality of stuffing pressure rollers. In this aspect, a change in the rotational speed of the at least one stuffing pressure motor would correspondingly change the rotational speed of each of the plurality of stuffing pressure rollers 44. Alternatively, if the at least one stuffing pressure roller comprises a plurality of stuffing pressure rollers, one stuffing pressure motor can drive at least one stuffing pressure roller 44, and a second stuffing pressure motor can drive at least one stuffing pressure roller. In this example, each roller of the at least one stuffing pressure roller can be coupled to a respective stuffing pressure motor 50.

In one aspect, at least one sensor 20 of the plurality of sensors can be a stuffing pressure sensor 52. The stuffing pressure sensor can be a proximity sensor configured to sense the absence or presence of an object, according to one aspect. In another aspect, the stuffing pressure sensor can be a photoelectric sensor configured to sense the absence or presence of an object by using a light transmitter and a photoelectric receiver. For example and without limitation, the stuffing pressure sensor 52 can be a Model BOS 21M-PA-PK10-24 sensor produced by BALLUFF of Neuhausen, Germany. In a further aspect, the stuffing pressure sensor can be an encoder coupled to the at least one stuffing pressure roller 44 or the at least one stuffing pressure motor 50 and configured to sense the rotational speed of the roller or motor. For example, the stuffing pressure sensor 52 can be a Model T8.LI20.1121.2005 READ HEAD, a Model T8.A02H.5BAE.0512 40MM or a Model T8.5020.1552.0512 encoder produced by TURCK of Plymouth, Minn. It is contemplated, however, that other types of stuffing pressure sensors could be used.

In one aspect, the stuffing pressure sensor 52 can be positioned adjacent the at least one stuffing pressure roller 44 so that the signal transmitted from the stuffing pressure sensor (such as light) can be directed toward the identifying mark 28 on the outer surface 46 of the at least one stuffing pressure roper. In another aspect, the stuffing pressure sensor can be positioned adjacent the at least one stuffing pressure roller. In a further aspect, the stuffing pressure sensor 52 can be spaced from the at least one stuffing pressure roller a predetermined distance. For example, the stuffing pressure sensor can be spaced from the at least one stuffing pressure roller 44 by less than 1 inch, about 1 inch, 2 inches, about 3 inches, about 4 inches, about 5 inches, about 6 inches, or greater than about 6 inches. If the stuffing pressure sensor 52 is an encoder, as discussed above, the stuffing pressure sensor can be coupled to the at least one stuffing pressure roller 44 or the at least one stuffing pressure motor 50, according to another aspect.

Figure 6:
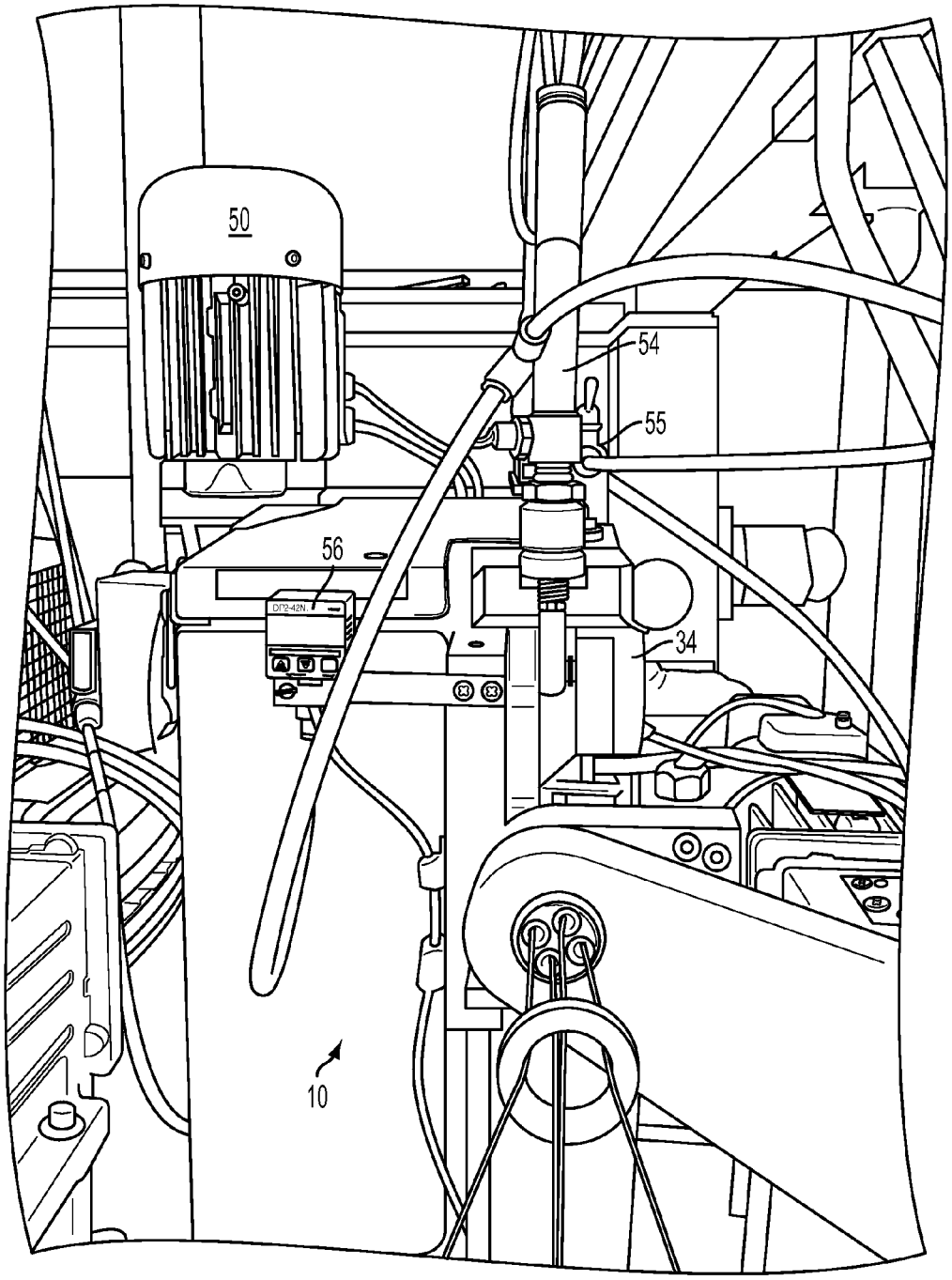
FIG. 6 is a perspective view of a jack pressure cylinder and sensor of the system for monitoring, improving and/or controlling yarn texture of FIG. 1, according to one aspect.
Figure 7:
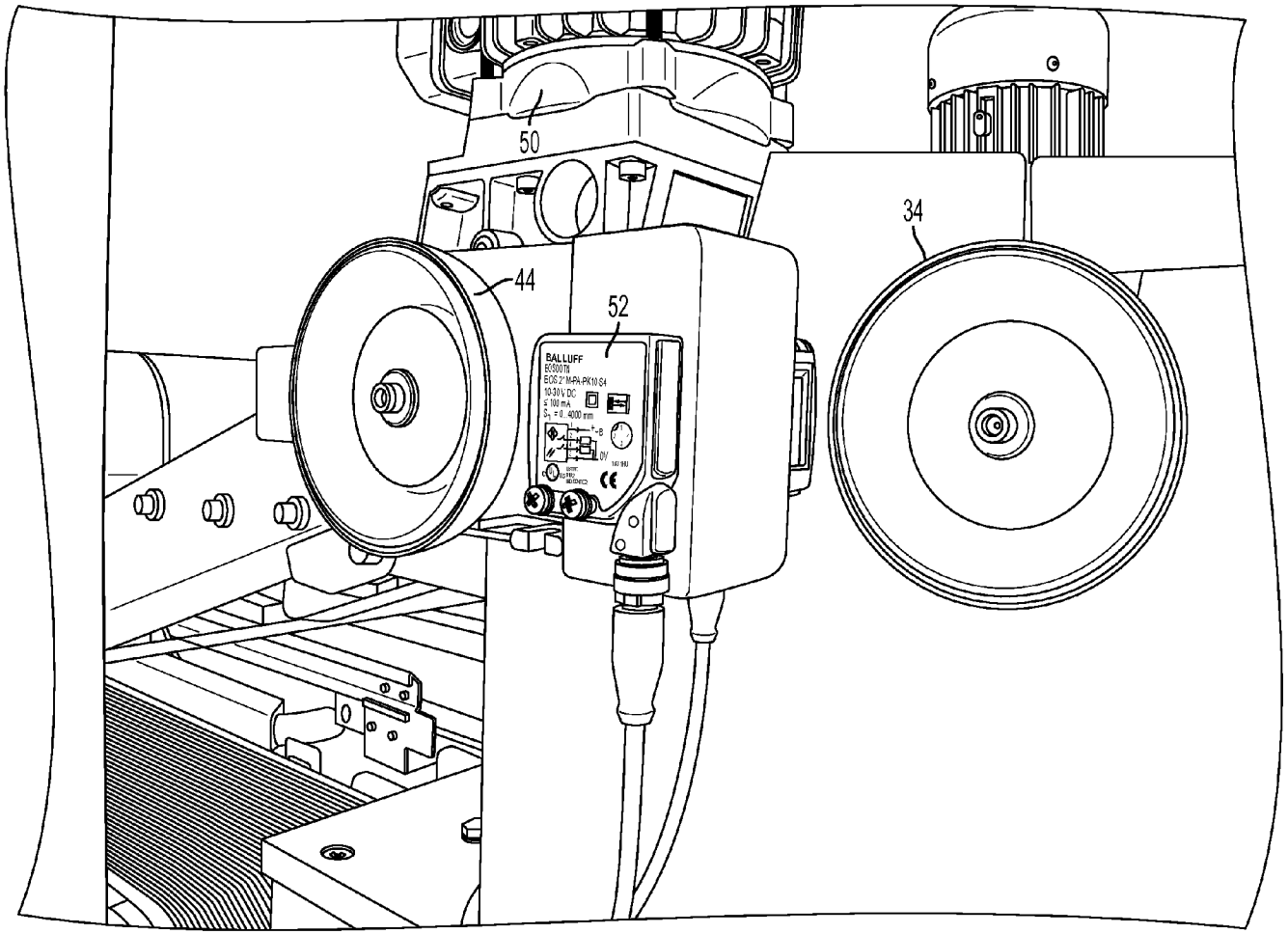
FIG. 7 is a perspective view of a roller and roper speed sensor of the system for monitoring, improving and/or controlling yarn texture of FIG. 1, according to one aspect.

Within the texturing apparatus 16, the at least one delivery roller 34 can be configured to move laterally relative to the direction that yarn 14 is moving. That is, if the yarn is moving from left to right, the at least one delivery roller can be configured to move up and down. In one aspect, pressure can be applied to the at least one delivery roller 34 to prevent lateral movement of the roper. Variations in the position of the delivery roller can cause variations in tension of the yarn which can become visible when the yarn is formed into a finished product, such as carpet. In another aspect and with reference to FIG. 6, a pneumatic jack cylinder 54 can be positioned adjacent the at least one delivery roller 34. In this aspect, the pneumatic jack cylinder can be coupled to the at least one delivery feed roller and configured to selectively apply a predetermined jack pressure to the at least one delivery roller 34. For example, the pneumatic jack cylinder 54 can apply sufficient jack pressure to the at least one delivery feed roller to prevent lateral movement of the at least one delivery roller 34. In one aspect, a source of compressed air 57, such as a compressor, a charged air container, and the like can be in fluid communication with the pneumatic jack cylinder. In another aspect, a valve, nozzle, or other fluid flow adjustment device 55 can be positioned between the source of compressed air and the pneumatic jack cylinder 54 so that the pressure exerted by the jack cylinder can be selectively adjusted to a predetermined level.

In one aspect, at least one sensor 20 of the plurality of sensors can be a jack pressure sensor 56. The jack pressure sensor can be a pressure sensor configured to sense the pressure exerted by the pneumatic jack cylinder 54 on the at least one delivery roller 34. In another aspect, the jack pressure sensor 56 can be a transducer configured to generate an electric sensor as a function of the pressure exerted. For example and without limitation, the jack pressure sensor can be a Model DP2-42N pressure sensor produced by SUNX and distributed by RAMCO INNOVATIONS of Des Moines, Iowa. It is contemplated, however, that other types and/or brands of pressure sensors could be used.

In one aspect, the jack pressure sensor 56 can be in fluid communication with the pneumatic jack cylinder 54 so that the pressure exerted by the jack cylinder on the at least one delivery roller 34 is also exerted on and therefore sensed by the jack pressure sensor.

Within the stuffer box 58 of the texturing apparatus 16, a stream of transport air 53 and/or other gas can be directed in the direction of yarn travel to aid in transporting the yarn 14 through the texturing apparatus. That is, the transport air can have a flow rate and/or pressure configured to transport yarn through the texturing apparatus. For example, if the yarn is moving from left to right, the transport air 53 can have an air flow rate and/or air pressure moving generally from left to right and configured to assist the transportation of yarn 14 in the stuffer box. In one aspect, the source of compressed air 57, such as a compressor, a charged air container, and the like can be in fluid communication with the texturing apparatus 16 so that the stream of transport air can be formed in the stuffer box 58. In another aspect, a valve, nozzle, or other fluid flow adjustment device 55 can be positioned between the source of compressed air and the stuffer box so that the flow rate and/or air pressure of the transport air 53 in the stuffer box 58 can be selectively adjusted to a predetermined level.

In one aspect, at least one sensor 20 of the plurality of sensors can be a transport air pressure sensor 60. The transport air pressure sensor can be a pressure sensor configured to sense the pressure exerted by the transport air 53 on the yarn 14 in the stuffer box 58 of the texturing apparatus 16. In another aspect, the transport air pressure sensor 60 can be a transducer configured to generate an electric sensor as a function of the pressure exerted. For example and without limitation, the transport air pressure sensor can be a Model DP2-42N pressure sensor produced by SUNX and distributed by RAMCO INNOVATIONS of Des Moines, Iowa. It is contemplated, however, that other types and/or brands of pressure sensors could be used.

In one aspect, the transport air pressure sensor 60 can be in fluid communication with the flow of transport air 53 so that the pressure exerted by the transport air on the yarn 14 can be sensed by the transport air pressure sensor. For example, a transport air supply line can be coupled to the transport air pressure sensor 60.

In one aspect, steam can be applied to the yarn 14 at a predetermined temperature and pressure to condition the yarn during the texturing process in the stuffer box 58. In another aspect, steam can be supplied from a source of steam, such as, for example and without limitation, a boiler, to the texturing apparatus 16. In another aspect, a steam valve, nozzle, or other fluid flow adjustment device 55 can be positioned between the source of steam and the stuffer box 58 of the texturing apparatus so that the flow rate and/or steam pressure of the steam being supplied to the internal chamber can be selectively adjusted to a predetermined level.

In one aspect, at east one sensor 20 of the plurality of sensors can be a steam pressure sensor 62. The steam pressure sensor can be a pressure sensor configured to sense the pressure exerted by the steam being supplied to the stuffer box 58. In another aspect, the steam pressure sensor can be a transducer configured to generate an electric sensor as a function of the pressure exerted. For example and without limitation, the steam pressure sensor 62 can be a Model 10-60-1-1-2-7 transducer produced by NOSHOK of Berea, Ohio. It is contemplated, however, that other types and/or brands of pressure sensors could be used.

In one aspect, the steam pressure sensor 62 can be in fluid communication with the flow of steam supplied to the stuffer box 58 of the texturing apparatus 16 so that the steam pressure exerted by the steam can be sensed by the steam pressure sensor.

Figure 8:
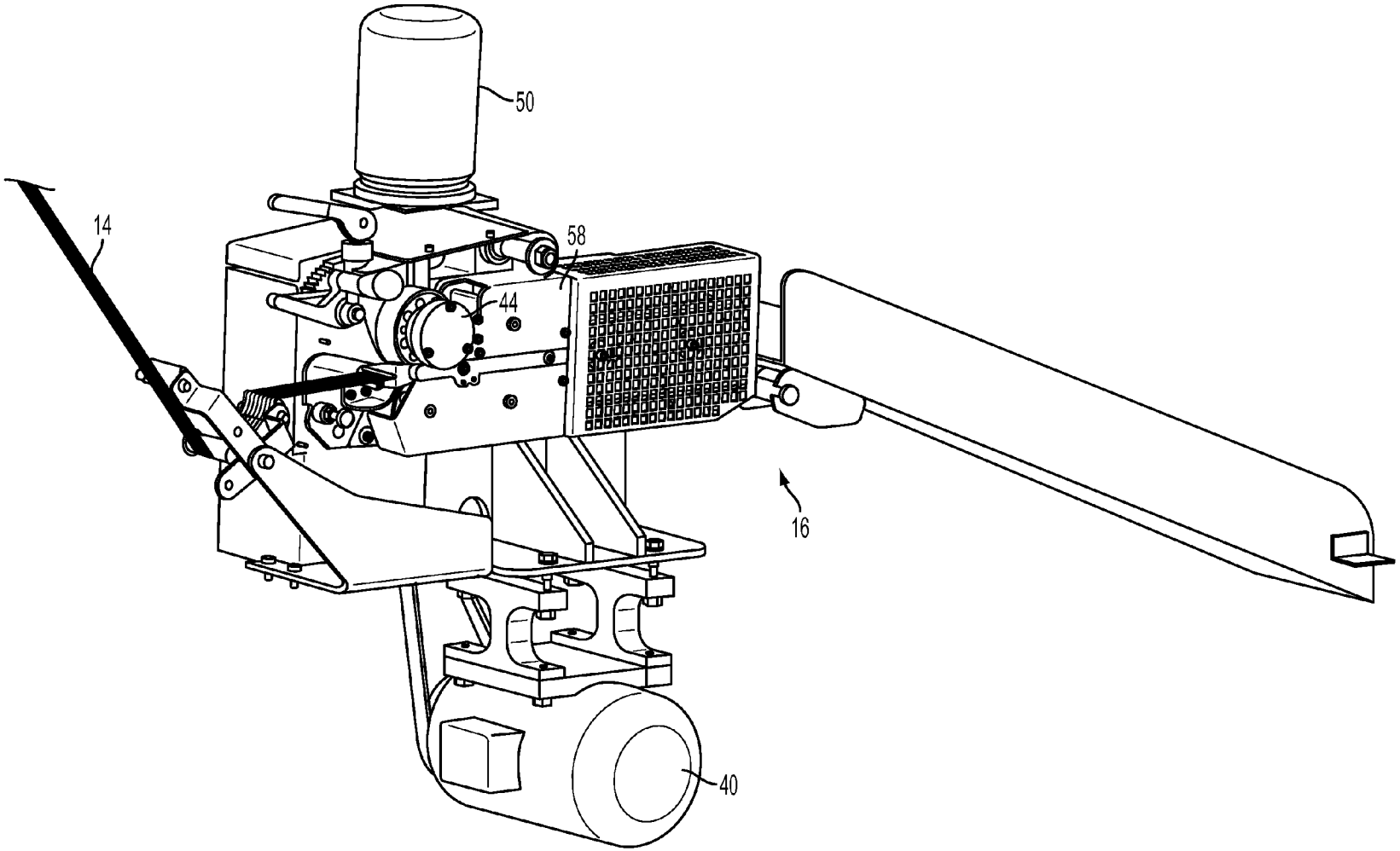
FIG. 8 is a diagram of a texturing apparatus having a stuffer box, according to one aspect.
Figure 9:
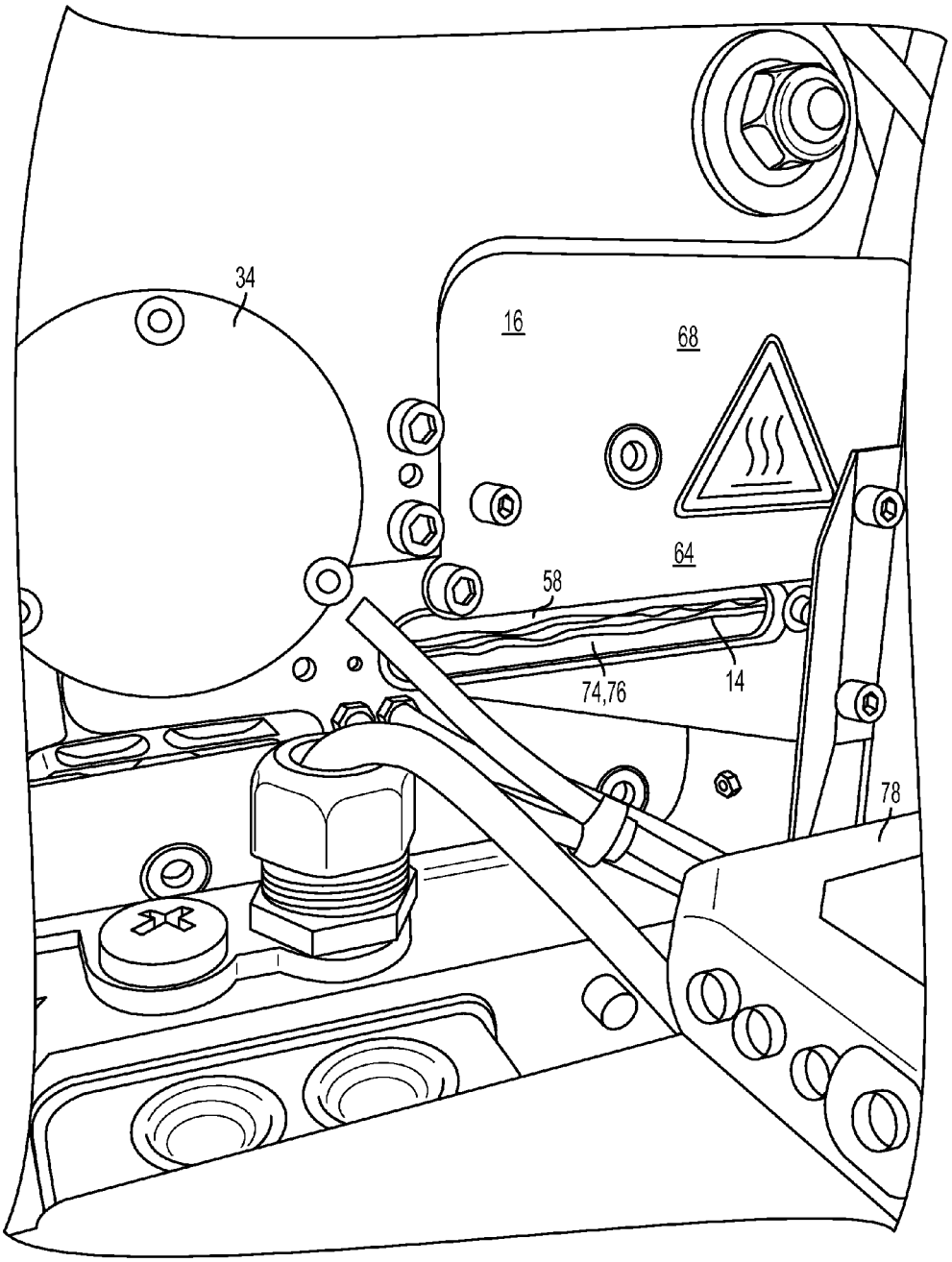
FIG. 9 is a perspective view of a sensor and the stuffer box of FIG. 8, wherein the sensor is configured to sense the presence of a yarn plug in the stuffer box according to one aspect.

As previously discussed, in one aspect, the texturing apparatus 16 comprises the steer box 58 as illustrated in FIGS. 8 and 9. In another aspect, the stuffer box can be any housing 66 defining an internal chamber 64 having an inlet end and an outlet end through which yarn can pass. For example, the stuffer box 58 can simply be a chamber through which a yarn strand or strands can pass. In another example, the stuffer box can be a texturing chamber within which yarn is allowed to selectively pile up, thereby forming a yarn plug. In another aspect, the stuffer box can be a portion of a twin roll box ("TRB").

In one aspect, the stuffer box 58 can comprise at least one side wall 68. For example, if the steer box is substantially cylindrical in shape, the steer box can have one side wall 68 that is substantially circular when viewed in cross-section. If the stuffer box is substantially rectangular or square in cross-sectional shape, the stuffer box can have two sidewalls, a top wall 70, and a bottom wall 72.

In one aspect, at least one bore 74 can be defined in a portion of the at least one side wall 68 to form a window 76 such that the internal chamber 64 of the staler box 58 is visible through the window. In another aspect, a transparent or translucent material can cover the bore to prevent yarn from exiting the internal chamber through the bore, while allowing light to enter and exit the internal chamber 64. For example, the bore can be covered with glass, a transparent thermoplastic material such as Poly (methyl methacrylate) ("PMMA") and the like. It is of course contemplated that the at least one bore can be defined in a portion of the top wall 70, the bottom wall 72, as well as the at least one side wall. As previously discussed, yarn can be fed to the stuffer box 58 by the at least one delivery roller 34.

In one aspect, at least one sensor 20 of the plurality of sensors can be a yarn plug sensor 78. In another aspect, the yarn plug sensor can be a proximity sensor configured to sense the absence or presence of a yarn plug. In another aspect, the yarn plug sensor 78 can be a photoelectric sensor configured to sense the absence or presence of a yarn plug by using a light transmitter and a photoelectric receiver. For example and without limitation, the yarn plug sensor can be a Model B080089 produced by BALLUFF of Neuhausen, Germany. In still another aspect, the yarn plug sensor can be a digital camera configured to sense the absence or presence of a yarn plug by imaging the internal chamber 64 through the window 76 and processing the image viewed. For example, the yarn plug sensor 78 can be a Model C4G1-24G-E00 vision sensor produced by COGNEX of Natick, Mass. It is contemplated, however, that other types of sensors for detecting the absence or presence of a yarn plug could be used.

The yarn plug sensor 78 can be positioned adjacent the window 76 of the stuffer box 58 so that the signal transmitted from the yarn plug sensor (such as light) can pass through the window into the internal chamber 64 of the stuffer box. In one aspect, the yarn plug sensor 78 can be positioned adjacent the window. In another aspect, the yarn plug sensor can be spaced from the window 76 a predetermined distance. For example, the yarn plug sensor 78 can be spaced from the window by less than 1 inch, about 1 inch, 2 inches, about 3 inches, about 4 inches, about 5 inches, about 6 inches, or greater than about 6 inches. In still another aspect, the yarn plug sensor can be positioned such that a predetermined location of the internal chamber 64 is being monitored. In another aspect, the yarn plug sensor 78 can be positioned to sense a yarn plug only in, without limitation, an upper, lower, forward or rear portion of the internal chamber 64.

In one aspect, a reflective surface can be positioned on an internal surface of the at least one side wall 68 of the stuffer box 58 opposed from the window 76. For example, a reflective tape or paint can be positioned on an opposite side of the internal chamber 64 from the window. Alternatively, the stuffer box can be formed from a material having a reflective surface so that the use of reflective tape or paint is not required. For example, at least a portion of the stuffer box 58 on an opposite side of the window 76 can be formed from a metallic material, such as aluminum, stainless steel and the like.

In one aspect, upon exiting the texturing apparatus 16, the yarn 14 can be transported to the climate chamber 18, such as a steamer, an oven, a dryer and the like. In another aspect, the climate chamber can have a temperature above the ambient temperature. After being heated in the climate chamber 18, the yarn can be cooled by at least one vacuum fan 80 and transported to a winder 82 for packaging. In one aspect, the at least one vacuum fan can be electrically coupled to a fan motor 84 configured to rotate the fan at a predetermined speed. In another aspect, the fan motor can be a variable speed motor configured to rotate the vacuum fan 80 at a selectable speed and vary the vacuum force exerted on the yarn 14. Further, the amount of vacuum force exerted on the yarn can be varied by, for example and without limitation, changing the area of yarn exposed to the vacuum fan.

Figure 10:
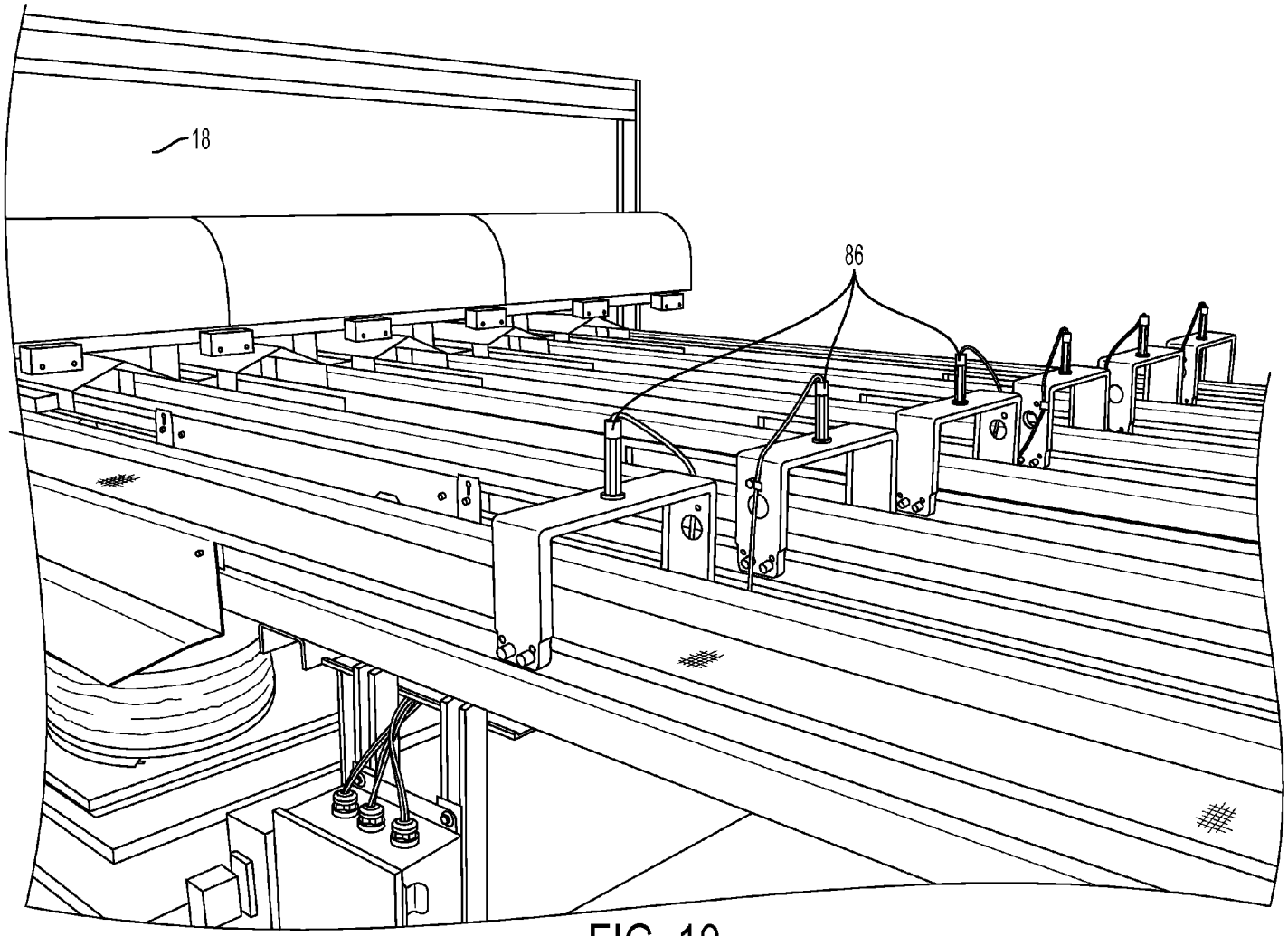
FIG. 10 is a perspective view of a yarn temperature sensor of the system for monitoring, improving and/or controlling yarn texture of FIG. 1, according to one aspect.

Referring now to FIG. 10, in one aspect, at least one sensor 20 of the plurality of sensors can be a yarn temperature sensor 86. The yarn temperature sensor can be a temperature sensor configured to sense the temperature of the yarn after being cooled by the at least one vacuum fan 80. In another aspect, the yarn temperature sensor 86 can be an infrared thermometer, a thermocouple, a resistance temperature detector and the like configured to generate an electric sensor as a function of the sensed temperature. For example and without limitation, the yarn temperature sensor can be a Model RAYCMLTV3 infrared temperature sensor produced by RAYTEK of Santa Cruz, Calif. It is contemplated, however, that other types and/or brands of temperature sensors could be used.

The yarn temperature sensor 86 can be positioned adjacent the yarn 14 after the yarn has been cooled by the at least one vacuum fan 80 so that the signal transmitted from the yarn temperature sensor (such as infrared light) can contact the yarn. In one aspect, the yarn temperature sensor 86 can be spaced from the yarn 14 a predetermined distance. For example, the yarn temperature sensor can be spaced from the yarn by less than 1 inch, about 1 inch, 2 inches, about 3 inches, about 4 inches, about 5 inches, about 6 inches, or greater than about 6 inches.

Figure 11:
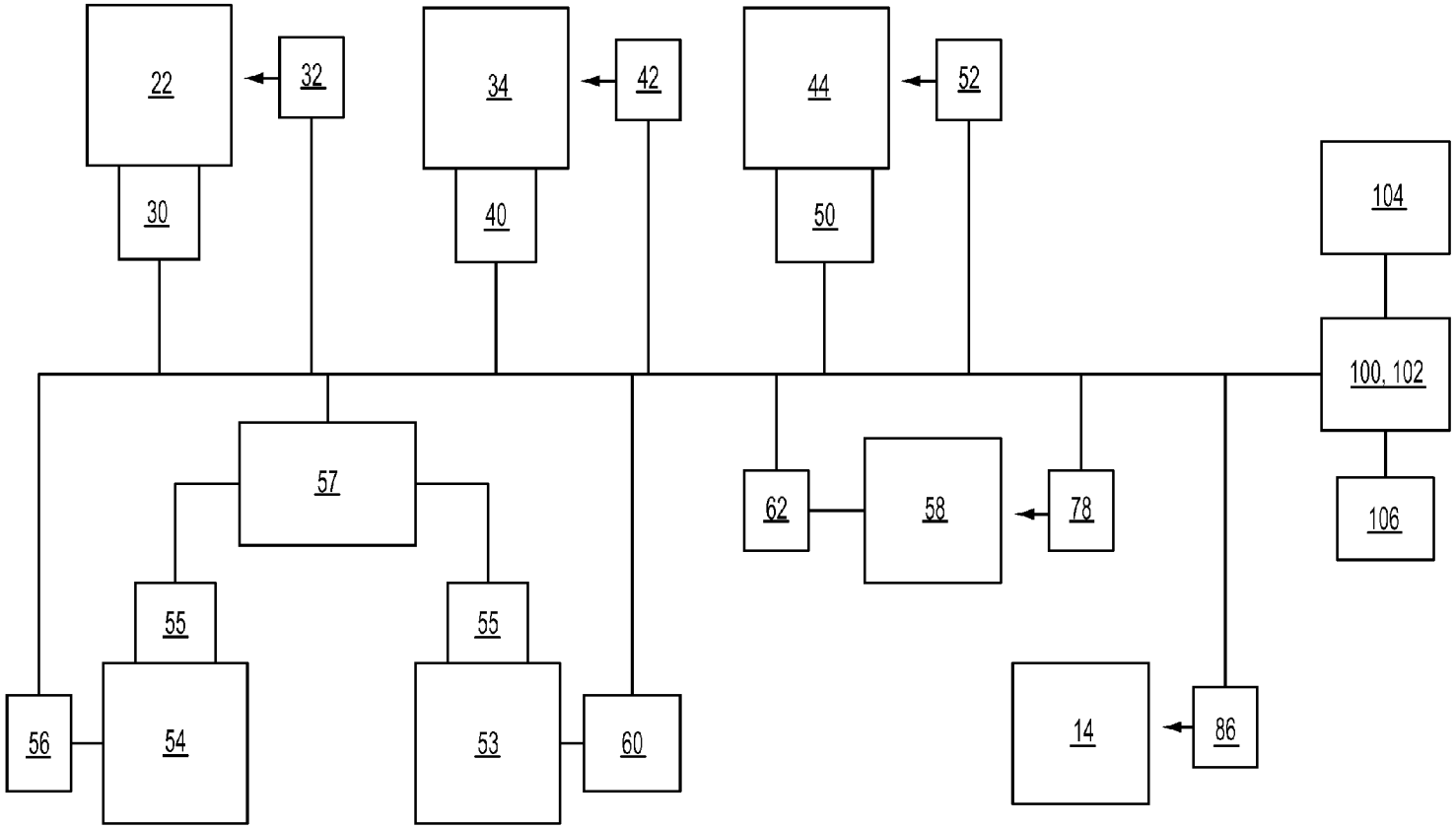
FIG. 11 is a schematic diagram showing a processor of the system for monitoring, improving and/or controlling yarn texture of FIG. 1 coupled to a plurality of sensors, a plurality of motors, and to sources of steam and compressed air, according to one aspect.

Referring now to FIG. 11, in one aspect, the system 10 for controlling and improving the consistency of yarn texture further comprises a control system 100. In this aspect, each sensor 20 of the plurality of sensors can be electrically coupled to the control system.

In one aspect, the control system 100 can comprise a processor 102 electrically coupled to each sensor 20 of the plurality of sensors and programmed to selectively monitor, display, set and/or control at least one of the operating parameters of the yarn system, as illustrated in FIG. 11. In another aspect, the processor can be electrically coupled to at least one of the at least one overfeed motor 30, the at least one delivery motor 40, and the at least one stuffing pressure motor 50. Thus, in this aspect, the processor can be configured to monitor, display, set and/or control the speed at which at least one of the at least one overfeed roller 22, the at least one delivery roller 34, and/or the at least one stuffing pressure roller 44 rotates. As can be appreciated, changing the rotational speed of any of these driven rollers can change the tension in the yarn and/or the speed at which the yarn 14 is moving through the yarn system.

In a further aspect, the processor 102 can be electrically coupled to the source of compressed air 57 supplied to the pneumatic jack cylinder 54 and/or the fluid flow adjustment device 55 coupled to the jack cylinder. In this aspect, the processor can be configured to monitor, display, set and/or control the pressure exerted by the jack cylinder on the at least one delivery roller 34. In a further aspect, the processor 102 can be electrically coupled to the source of compressed air supplied to the air transport stream and/or the fluid flow adjustment device 55 coupled to the air transport stream. In this aspect, the processor can be configured to monitor, display, set and/or control the pressure exerted by the air transport stream on the yarn 14 in the internal chamber 64 of the texturing apparatus 16. In a further aspect, the processor 102 can be electrically coupled to the source of steam supplied to the internal chamber of the texturing apparatus and/or the fluid flow device adjustment 55 coupled to the source of steam. In this aspect, the processor can be configured to monitor, display, set and/or control the temperature and/or pressure of the steam being supplied to the internal chamber 64 of the texturing apparatus 16. In a further aspect, the processor 102 can be electrically coupled to the fan motor 84 of the at least one vacuum fan 80. In this aspect, the processor can be configured to monitor, display, set and/or control the temperature of the yarn 14 after being cooled by the at least one vacuum fan by controlling the rotational speed of the at least one vacuum fan.

For example, in one aspect, the at least one delivery motor 40 can be electrically coupled to the processor 102 and configured to selectively speed up or slow down the at least one delivery roller 34 as necessary to provide for a desired rate of yarn to be processed. In another example, the overfeed motor 30 can be electrically coupled to the processor and configured to selectively speedup/down the at least one overfeed roller 22 as necessary to provide for desired rate of yarn fed to the stuffer box 58. In another example, the processor 102 can be configured to selectively stop the overfeed roller as necessary to prevent yarn 14 from entering the stuffer box.

With reference again to FIG. 11, in one aspect, the system 10 can further comprise a tinier 106. In this aspect, the tinier can be electrically coupled to at least one sensor 20 of the plurality of sensors and/or the processor 102. The timer can be configured to measure the amount of time passed upon receiving a signal from the at least one sensor and/or the processor. In another aspect, the timer can be a Series 6313 Solid State 10 Amp Rated Plug in Timing Relay manufactured by AMERICAN CONTROL PRODUCTS of Westport, Conn.

In one aspect, the processor 102 of the control system 100 can comprise, for example and without limitation, a computer or a Programmable Logic Controller (PLC), that is in communication with a display device 104. In another aspect, the processor can be configured as part of a feedback control loop to selectively control the speed of the yarn 14 within a predetermined tolerance based on the speed sensed by the at least one sensor 20. In still another aspect, the processor 102 can be configured as part of a feedback control loop to selectively control any operating parameter of the yarn system, such as yarn speed, yarn temperature, air pressure, steam pressure, and the like, within a predetermined tolerance based on the operating parameters sensed by the at least one sensor 20

Figure 12:
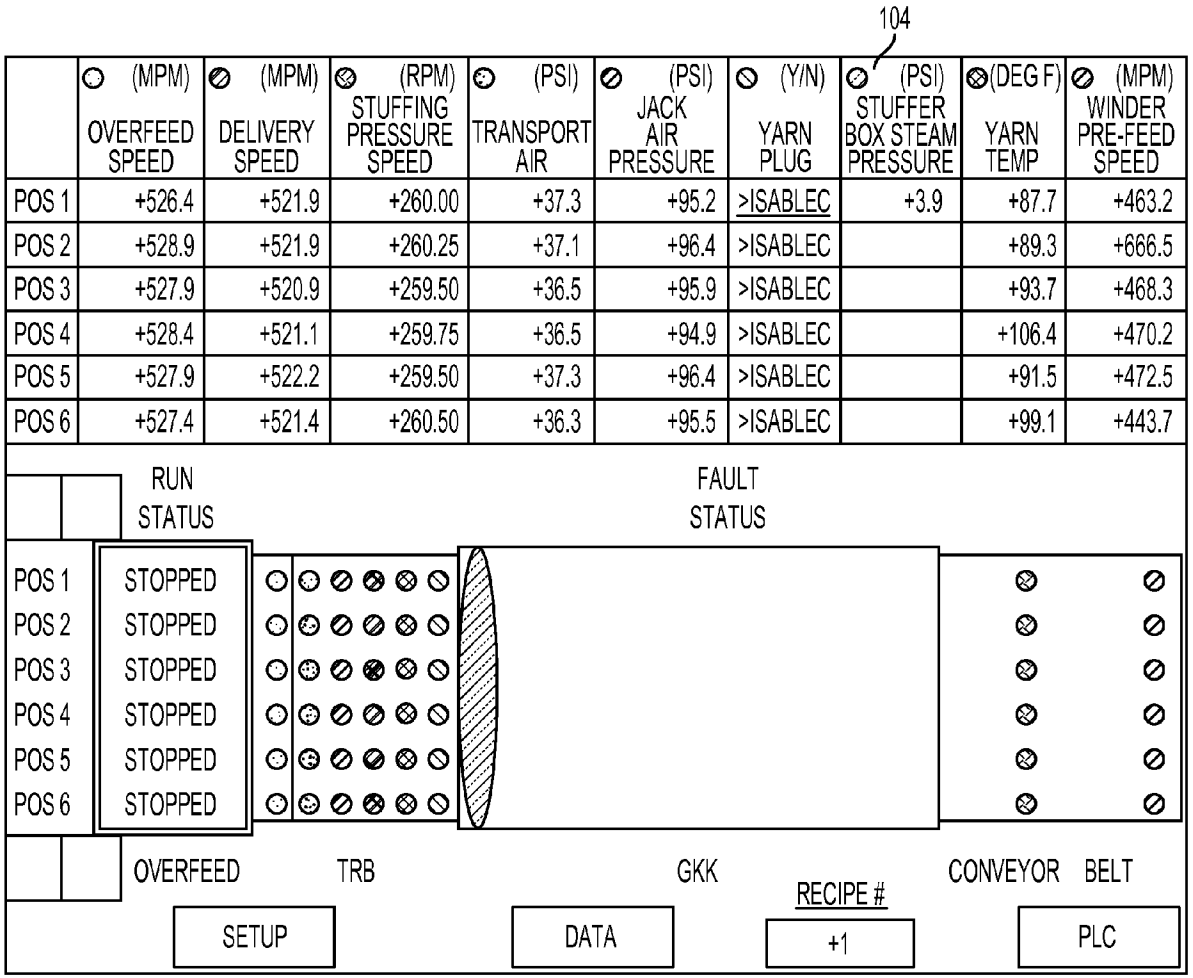
FIG. 12 is a view of a display device of the system for monitoring, improving and/or controlling yarn texture of FIG. 1.

With reference to FIG. 12, in one aspect, the control system 100 can further comprise the display device 104 configured to display at least one of: the speed at which the at least one overfeed roller 22 is rotating, the speed at which the at least one delivery roller 34 is rotating, and the speed at which the at least one stuffing pressure roller 44 is rotating. As can be appreciated, because the diameter of each of these driven rollers in known, the rotational speed of any of the driven rollers can be converted to a liner speed at which yarn 14 is moving through the system 10. In another aspect, the display device 104 can be configured to display at least one of: the transport air pressure, the jack cylinder 54 air pressure, the steam pressure in the internal chamber 64 of the texturing apparatus 16, and the temperature of the yarn 14 after it has been cooled by the at least one vacuum fan 80.

In one aspect, the control system 100 can further comprise a means for storing at least one recipe. In this aspect, the at least one recipe can comprise the operating parameters to form a yarn having a predetermined texture. For example, upon the selection of a recipe by a user, the control system can display the operating parameters of at least one of: the speed of the at least one overfeed motor 30, the speed of the at least one delivery motor 40, the speed of the at least one stuffing pressure motor 50, the jack pressure exerted by the jack cylinder 54, the transport air pressure, the stuffer box 58 steam pressure, and the speed of the vacuum fan motor 84 so that the user can set the yarn system to the appropriate operating parameters. In another example, upon the selection of a recipe by a user, the control system can automatically adjust the operating parameters of at least one of: the speed of the at least one overfeed motor, the speed of the at least one delivery motor, the speed of the at least one stuffing pressure motor, the jack pressure exerted by the jack cylinder, the transport air pressure, the stuffer box steam pressure, and the speed of the vacuum fan motor to the recipe setpoint in order to produce yarn having the predetermined texture.

In use, yarn 14 can be wrapped around at least a portion of the outer surface of the at least one overfeed roller 22, the at least one delivery roller 34 and the at least one stuffing pressure roller 44. Either manually by a user, or automatically by the processor 102, the transport air 53 can be turned on, jack pressure can be exerted by the jack cylinder 54, steam can be supplied to the internal chamber 64 of the stuffer box 58, and the climate chamber 18 can be brought to a desired temperature. Either manually by a user, or automatically by the processor 102, the at least one overfeed motor 30, the at least one delivery motor 40 and the at least one stuffing pressure motor 50 can be started so that the respective driven rollers rotate and yarn moves through at least a portion of the yarn system.

In one aspect, the overfeed sensor 32 sensor can send a continuous signal, such as light, to the outer surface 26 of the at least one overfeed roller 22. When the identifying mark 28 rotates to a predetermined position, the signal from the overfeed sensor can be reflected by the identifying mark back to the overfeed sensor 32. Based upon how often the overfeed sensor senses the identifying mark, the rotational speed of the at least one overfeed roller 22 can be calculated by the overfeed sensor 32 and/or the processor 102. Optionally, this rotational speed can be displayed on the display device 104. Further, based upon the outer diameter $D_1$ of the at least one overfeed roller, the speed of the yarn 14 (such as "x" meters/minute) can be calculated and displayed on the display device. Note that this process can be repeated by the delivery sensor 42 and the stuffing pressure sensor 52 for measuring the respective speed of both the at least one delivery roller 34 and the at least one stuffing pressure roller 44.

In one aspect, the speed of the at least one overfeed roller 22, and thus, the speed of the yarn 14, can be controlled to within a predetermined speed tolerance of a desired speed set point. In another aspect, the predetermined speed tolerance could be the desired speed+/−about 1 m/min, 5 m/min, 10 m/min, 15 m/min, 20 m/min, 25 m/min, 30 m/min, 35 m/min, 40 m/min, 45 m/min, 50 m/min, or greater than +/−50 m/min. In still another aspect, the predetermined speed tolerance could be a percentage of the desired speed, such as the desired speed+/−about 1%, 5%, 10%, 15%, 20%, 25%, 30%, 35%, 40%, 45%, 50%, or greater than +/−50%. For example, if the yarn is traveling 500 meters/minute ("m/min") around the at least one overfeed roller 22, as sensed by the overfeed sensor 32, the predetermined speed tolerance could be 500+/−5 m/min, or between 495 and 505 m/min. As long as the speed sensed by the overfeed sensor stays within the predetermined speed tolerance (in this example, between 495 and 505 m/min), no adjustment of the speed of the at least one overfeed roller 22 is required. If however, the overfeed sensor senses that the speed of the at least one overfeed roller is outside of the predetermined speed tolerance, then adjustment of the speed of the at least one overfeed roller 22 can be made by a user monitoring the display device 104, or automatically by the processor 102. Again, note that control and/or adjustment of the speed of both the at least one delivery roller 34 and the at least one stuffing pressure roller 44 can be similar to that as described here for the at least one overfeed roller.

In another aspect, the speed of the at least one overfeed roller 22, the at least one delivery roller 34 and the at least one stuffing pressure roller 44 can be controlled to within a predetermined speed tolerance of each other (i.e., as a ratio of the speed of one driven roller to the speed of a second driven roller). For example, the speed of the delivery roller can be set to within a predetermined speed tolerance of the overfeed roller 22 and/or the stuffing pressure roller 44. In another aspect, the predetermined speed tolerance could be the desired speed+/−about 1 m/min, 5 m/min, 10 m/min, 15 m/min, 20 m/min, 25 m/min, 30 m/min, 35 m/min, 40 m/min, 45 m/min, 50 m/min, or greater than +/−50 m/min. In still another aspect, the predetermined speed tolerance could be a percentage of the desired speed, such as the desired speed+/−about 1%, 5%, 10%, 15%, 20%, 25%, 30%, 35%, 40%, 45%, 50%, or greater than +/−50%. For example, if the yarn is traveling 500 meters/minute ("m/min") around the at least one overfeed roller 22, as sensed by the overfeed sensor 32, the predetermined speed tolerance could be 500+/−5 m/min, or between 495 and 505 m/min. In this example then, as long as the speed sensed by the overfeed sensor 32, the delivery sensor 42 and/or the stuffing pressure sensor 52 stays within the predetermined speed tolerance (i.e., between 495 and 505 m/min), no adjustment of the speed of the driven rollers is required. If however, the overfeed sensor 32, the delivery sensor 42 and/or the stuffing pressure sensor 52 senses that the speed of the respective driven roller is outside of the predetermined speed tolerance, then adjustment of the speed of at least one of the driven rollers 22, 34, 44 can be made by a user monitoring the display device 104, or automatically by the processor 102.

In one aspect, the predetermined speed tolerance can be a ratio of the speed of a first roller to the speed of a second roller. For example, the predetermined speed tolerance of the at least one delivery roller 34 can be +/− less than about 1%, about 1%, 5%, 10%, 15%, 20%, 25%, 30%, 35%, 40%, 45%, 50%, or greater than +/−50% of the speed of the at least one overfeed roller 22. In another example, the predetermined speed tolerance of the at least one stuffing pressure roller 44 can be +/− less than about 1%, about 1%, 5%, 10%, 15%, 20%, 25%, 30%, 35%, 40%, 45%, 50%, or greater than +/−50% of the speed of at least one overfeed roller. In this example, as long as the ratio of speeds sensed stay within the predetermined speed tolerance no adjustment of the speed of the driven rollers is required. If however, the overfeed sensor 32, the delivery sensor 42 and/or the stuffing pressure sensor 52 senses that the ratio of the speed of the respective driven roller to another roller is outside of the predetermined speed tolerance, then adjustment of the speed of at least one of the driven rollers 22, 34, 44 can be made by a user monitoring the display device 104, or automatically by the processor 102.

In one aspect, the jack pressure sensor 56 can be in continuous fluid communication with the compressed fluid supplied to the jack cylinder 54. The jack pressure sensor can sense the pressure of this compressed fluid (the pressure exerted by the jack cylinder) and can send a signal representative of this pressure to the processor 102 and/or the display device 104. In another aspect, the steam pressure sensor 62 can be in continuous fluid communication with the source of steam supplied to the stuffer box 58. The steam pressure sensor can sense the pressure of the steam in the stuffer box and can send a signal representative of this pressure to the processor 102 and/or the display device 104.

In one aspect, the pressure exerted by the jack cylinder 54, the transport air 53 in the internal chamber 64 of the stuffer box 58, and/or the steam pressure in the stuffer box can be controlled to within a predetermined pressure tolerance of a desired pressure set point. In another aspect, the predetermined pressure tolerance could be the desired pressure+/−about 1 psi, 5 psi, 10 psi, 15 psi, 20 psi, 25 psi, 30 psi, 35 psi, 40 psi, 45 psi, 50 psi, or greater than +/−50 psi. In still another aspect, the predetermined pressure tolerance could be a percentage of the desired pressure, such as the desired pressure+/−about 1%, 5%, 10%, 15%, 20%, 25%, 30%, 35%, 40%, 45%, 50%, or greater than +/−50%. For example, if the jack pressure is about 100 psi, as sensed by the jack pressure sensor 56, the predetermined pressure tolerance could be 100 psi+/−10%, or between 90 and 100 psi. As long as the jack pressure sensed by the jack pressure sensor stays within the predetermined pressure tolerance (in this example, between 90 and 100 psi), no adjustment of the jack pressure is required. If however, the jack pressure sensor 56 senses that the jack pressure is outside of the predetermined pressure tolerance, then adjustment of the jack pressure can be made by a user monitoring the display device 104, or automatically by the processor 102.

In one aspect, the yarn temperature sensor 86 sensor can send a continuous signal, such as infrared light, to the yarn 14 that has been cooled by the at least one vacuum fan 80. The sensor can sense the temperature of the yarn and can send a signal representing this temperature to the processor 102 and/or the display device 104.

In one aspect, the temperature of the yarn 14 can be controlled to within a predetermined temperature tolerance of a desired temperature set point. In another aspect, the predetermined temperature tolerance could be the desired temperature+/−about 1 degree, 5 degrees, 10 degrees, 15 degrees, 20 degrees, 25 degrees, 30 degrees, 35 degrees, 40 degrees, 45 degrees, 50 degrees, or greater than +/−50 degrees. In still another aspect, the predetermined temperature tolerance could be a percentage of the desired temperature, such as the desired temperature+/−about 1%, 5%, 10%, 15%, 20%, 25%, 30%, 35%, 40%, 45%, 50%, or greater than +/−50%. For example, if the yarn temperature is about 100 degrees as sensed by the yarn temperature sensor 86, the predetermined temperature tolerance could be 100+/−5 degrees, or between 95 and 105 degrees. As long as the temperature sensed by the temperature sensor stays within the predetermined temperature tolerance no adjustment of the temperature of the yarn 14 is required. If however, the temperature sensor senses that the temperature of the yarn is outside of the predetermined temperature tolerance, then adjustment of the amount of vacuum being exerted on the yarn by the at least one vacuum fan 80 can be made by a user monitoring the display device 104, or automatically by the processor 102.

In one aspect, the at least one yarn plug sensor 78 can send a signal through the window 76 of the stuffer box 58 to sense if a yarn plug is positioned in a predetermined position therein the internal chamber 64 of the stuffer box. In another aspect, if the sensor is an optical sensor, a beam of light can be sent through the window and into the internal chamber. If no yarn is present in the predetermined position of the internal chamber, the beam of light can reflect off the reflective surface of the stuffer box and be sensed by the sensor 20. If yarn 14 and/or another obstruction is present in the predetermined location, the yarn and/or another obstruction prevents the beam of light from reflecting off the reflective surface and the light is not sensed by the yarn plug sensor 78. A signal representing the presence or absence of the yarn plug in the predetermined position can be sent by the yarn plug sensor to the processor 102 and/or the display device 104.

In one aspect, the processor 102 can be programmed to selectively speed up, slow down or stop at least one of the driven rollers based at least partially on whether yarn has been sensed inside the predetermined location of the internal chamber 64. In another aspect, if no yarn is sensed inside the internal chamber, the processor can actuate at least one of the overfeed motor 30, the delivery motor 40 and the stuffing pressure motor 50, which actuates at least one of the driven rollers, and yarn can be fed into the inlet of stuffer box 58. In another aspect, if no yarn is sensed inside the internal chamber, the processor 102 can increase the pressure and/or flowrate of the stream of transport air 53 in the internal chamber to feed yarn 14 into the internal chamber. In still another aspect, if no yarn is sensed inside the internal chamber, the processor 102 can increase the pressure and/or flowrate of the stream of transport air 53 in the internal chamber and actuate at least one of the overfeed motor 30, the delivery motor 40 and the stuffing pressure motor 50, which actuates at least one of the driven rollers, and yarn can be fed into the inlet of stuffer box 58.

In an example, if yarn 14 is sensed in the predetermined position of the internal chamber 64 of the stuffer box 58, the processor 102 can stop at least one of stream of transport air 53, the overfeed motor 30, the delivery motor 40 and the stuffing pressure motor 50, which stops the respective driven roller, and yarn can stop being fed into the stuffer box. In another example, if yarn is sensed in the predetermined position of the internal chamber 64, the processor 102 can actuate stream of transport air, the overfeed motor 30, the delivery motor 40 and the stuffing pressure motor 50, or if the driven roller is already revolving, allow the driven roller to continue revolving at the same or an altered speed.

In still another example, if yarn 14 and/or another obstruction is detected in the predetermined location by the yarn plug sensor 78, the yarn plug sensor can send a signal to the timer 106 (such as, for example and without limitation, a 24V electrical signal). The timer can begin timing a first predetermined amount of time, such as for example and without limitation, less than 5 seconds, about 5 seconds, about 10 seconds, about 15 seconds, about 20 seconds, about 25 seconds, about 30 seconds, about 35 seconds, about 40 seconds, about 45 seconds, about 50 seconds, about 55 seconds, about 60 seconds, or greater than about 60 seconds. Upon expiration of the first predetermined amount of time, if yarn 14 and/or another obstruction is still detected in the predetermined location by the yarn plug sensor 78, the timer 106 can send a "stop" signal to the processor 102 to stop the at least one driven roller, the stream of transport air, and/or the texturing system. After sending the "stop" signal, the timer can time a second predetermined amount of time, which can be shorter than, the same as, or longer than the first predetermined amount of time. Upon expiration of the second predetermined amount of time, the at least one driven roller and/or the yarn system can selectively be restarted by a user or automatically by the processor.

In one aspect, upon starting of the at least one driven roller 22, 34, 44 and/or the yarn system, the timer 106 can begin timing a third predetermined amount of time, such as for example and without limitation, less than 5 seconds, about 5 seconds, about 10 seconds, about 15 seconds, about 20 seconds, about 25 seconds, about 30 seconds, about 35 seconds, about 40 seconds, about 45 seconds, about 50 seconds, about 55 seconds, about 60 seconds, or greater than about 60 seconds. In this aspect, in order to prevent false stops (i.e., stopping the driven roller and/or the texturing system because the yarn plug sensor 78 has falsely sensed a perceived obstruction in the internal chamber 64, such as steam), the processor can be prevented from stopping the driven roller and/or the yarn system until the timer has timed the third predetermined amount of time.

As can be appreciated, if any sensor of the plurality of sensors 20 senses a condition outside of the predetermined tolerance for a predetermined amount of time, the processor 102 can stop the system automatically or sound an alarm so that a user can stop or adjust the system. In one aspect, if any sensor of the plurality of sensors senses a condition outside of the predetermined tolerance for a predetermined amount of time, the processor can make an adjustment to at least one of: the speed of the at least one overfeed motor 30, the speed of the at least one delivery motor 40, the speed of the at least one stuffing pressure motor 50, the jack pressure exerted by the jack cylinder 54, the transport air pressure, the stuffer box 58 steam pressure, or the speed of the vacuum fan motor 84. Optionally, these adjustment(s) can be made manually by a user of the system. For example, if the yarn temperature sensor 86 senses a yarn temperature that is outside of the predetermined tolerance for a predetermined amount of time, the processor 102 could increase the vacuum fan speed and/or lower the speed of the driven rollers so that the yarn would travel slower through the system and would have more time to cool. Thus, the presence of one parameter outside of the predetermined tolerance for the predestined amount of time can lead to an adjustment of any or all of: the speed of the at least one overfeed motor 30, the speed of the at least one delivery motor 40, the speed of the at least one stuffing pressure motor 50, the jack pressure exerted by the jack cylinder 54, the transport air pressure, the stuffer box 58 steam pressure, and the speed of the vacuum fan motor 84.

Furthermore, because conventional heatset machines process a plurality of yarn positions at one time, it is understood that the processes and systems described herein can be on a single yarn position, on every yarn position, or on any combination of yarn positions. It is also contemplated that operating parameters common to each position (such as, for example and without limitation, stuffer box 58 steam pressure) can be sensed by a single steam pressure sensor 62 that can be applied to each yarn position of the machine.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for controlling and improving the consistency of a yarn texture in a yarn system, the method comprising:

moving yarn through the yarn system using a plurality of rollers, wherein at least one roller of the plurality of rollers is coupled to and driven by at least one roller motor, wherein the plurality of rollers comprise at least one delivery roller driven by a delivery motor and at least one overfeed roller driven by an overfeed motor;

using a texturing apparatus to receive yarn from the plurality of rollers, wherein the texturing apparatus comprises:

a stuffer box defining an internal chamber having an inlet end and an outlet end through which the yarn passes, and a climate chamber positioned downstream of the stuffer box;

using a source of compressed gas to move the yarn from the inlet end toward the outlet end of the internal chamber of the stuffer box;

using at least one transport air pressure sensor to sense the pressure of the compressed gas supplied by the source of compressed gas, wherein the at least one transport air pressure sensor is coupled to a processor;

heating the yarn within the climate chamber to set a desired texture in the yarn;

using at least one vacuum fan to cool the yarn after the yarn exits the climate chamber, using at least one yarn temperature sensor to sense a temperature of the yarn after the yarn is cooled by the vacuum fan, wherein the at least one yarn temperature sensor is coupled to the processor;

using the processor to stop operation of the yarn system when the at least one transport air pressure sensor senses a pressure outside of a transport air pressure tolerance for a first amount of time;

sensing additional operating parameters of the yarn system using a plurality of additional sensors, wherein the plurality of additional sensors are coupled to the processor; and using the processor to stop operation of the yarn system when an additional sensor of the plurality of additional sensors senses an operating parameter outside of a tolerance for the additional sensor for a second amount of time, wherein moving the yarn through the yarn system comprises:

using the at least one overfeed motor to deliver the yarn to the at least one delivery roller; and using the at least one delivery roller to deliver the yarn to the inlet end of the internal chamber of the stuffer box.

2. The method of claim 1, wherein at least one additional sensor of the plurality of additional sensors is a yarn plug sensor configured to sense the presence of a yarn plug in a yarn plug location in the internal chamber of the stuffer box.

3. The method of claim 2, wherein sensing the additional operating parameters of the yarn system comprises:

sensing the presence of the yarn plug in the yarn plug location in the internal chamber of the stuffer box for a third amount of time; and using the processor to stop operation of the yarn system when the yarn plug is not in the yarn plug location in the internal chamber of the stuffer box.

4. The method of claim 1, wherein the plurality of additional sensors comprises a delivery sensor and an overfeed sensor, wherein the delivery sensor and the overfeed sensor are coupled to the processor, and wherein the method comprises:

sensing a rotational speed of the at least one overfeed roller using the overfeed sensor;

sensing a rotational speed of the at least one delivery roller using the delivery sensor; and using the processor to stop operation of the yarn system when the overfeed sensor or the delivery sensor senses a rotational speed outside of a tolerance for the at least one overfeed roller or the at least one delivery roller.

5. The method of claim 1, further comprising using the processor to stop operation of the yarn system when the yarn temperature sensor senses the yarn temperature outside of a temperature tolerance.

6. The method of claim 1, wherein the yarn temperature sensor comprises an infrared temperature sensor.

7. The method of claim 1, wherein the temperature tolerance corresponds to a temperature within 25 degrees of a programmed yarn temperature.

8. The method of claim 1, wherein the temperature tolerance corresponds to a temperature within 15 degrees of a programmed yarn temperature.

9. The method of claim 1, wherein the temperature tolerance corresponds to a temperature within 5 degrees of a programmed yarn temperature.

10. The method of claim 1, wherein the temperature tolerance corresponds to a temperature within 25 percent of a programmed yarn temperature.

11. The method of claim 1, wherein the temperature tolerance corresponds to a temperature within 15 percent of a programmed yarn temperature.

12. The method of claim 1, wherein the temperature tolerance corresponds to a temperature within 5 percent of a programmed yarn temperature.

13. The method of claim 1, wherein at least one additional sensor of the plurality of additional sensors is a steam pressure sensor, and wherein the method comprises:

supplying pressurized steam to the yarn within the stuffer box;

using the steam pressure sensor to sense pressure exerted by the steam being supplied to the stuffer box; and using the processor to stop operation of the yarn system when the steam pressure sensor senses steam at a pressure outside a pressure tolerance.

* * * * *